United States Patent [19]

Nishi et al.

[11] Patent Number: 4,737,772

[45] Date of Patent: Apr. 12, 1988

[54] VIDEO DISPLAY CONTROLLER

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: Ascii Corporation, Tokyo; Nippon Gakki Seizo Kabushiki Kaisha, Hamamatsu, both of Japan

[21] Appl. No.: 739,036

[22] Filed: May 29, 1985

[30] Foreign Application Priority Data

May 31, 1984 [JP] Japan ..... 59-111613

[51] Int. Cl.[4] ..... G09G 1/28

[52] U.S. Cl. ..... 340/703; 340/701; 358/11; 358/22

[58] Field of Search ..... 340/703, 723, 744, 747, 340/701, 703, 793; 358/22, 31, 40, 22, 27, 40

[56] References Cited

U.S. PATENT DOCUMENTS

| | | | |
|---|---|---|---|
| 4,121,283 | 10/1978 | Walker | 340/703 |
| 4,155,095 | 5/1979 | Kirscher | 340/703 X |
| 4,303,912 | 12/1981 | Stafford et al. | 340/744 X |
| 4,442,428 | 4/1984 | Dean et al. | 340/703 |
| 4,464,676 | 8/1984 | Russell et al. | 340/744 X |
| 4,589,013 | 5/1986 | Vlahos et al. | 358/22 |
| 4,597,006 | 6/1986 | Orsburn | 358/22 |

*Primary Examiner*—Gerald L. Brigance
*Assistant Examiner*—Brier Jeffery A.
*Attorney, Agent, or Firm*—Cushman, Darby & Cushman

[57] ABSTRACT

A video display processor (VDP) produces a video signal by which a black and white image of an increased gradation can be displayed on a video display unit. The VDP reads from a video RAM (VRAM) either color codes each representative of a color of each display element, or amplitude data representative of amplitudes of a video signal to be reproduced. When displaying an image based on the color codes, the color codes are converted by a color palette circuit into color data each composed of three primary color data, and then supplied to a digital color encoder. The digital color encoder multiplies each of the three color data by predetermined coefficients at proper phase timings to output data representative of three chrominance signals. This output data is summed by an adder circuit and then converted into an analog signal to be supplied to the video display unit as the video signal. When displaying an image based on the amplitude data, the color palette circuit converts the amplitude data into gradation data. The digital color encoder multiplies the gradation data by other proper coefficients so that data proportional in value to the gradation data are obtained at the output of the adder circuit. This data is converted into an analog signal to thereby reproduce the video signal.

9 Claims, 9 Drawing Sheets

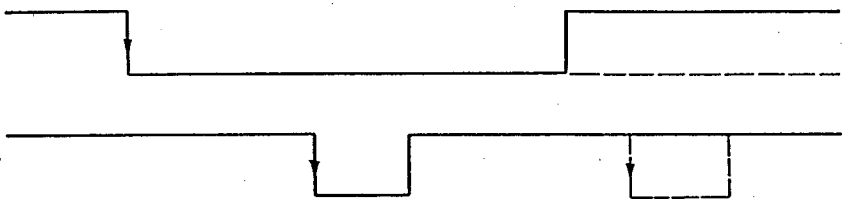
FIG. 9 (a) $\overline{RAS}$
FIG. 9 (b) $\overline{CASO}$
FIG. 9
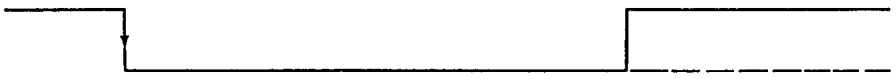
FIG. 10 (a) $\overline{RAS}$
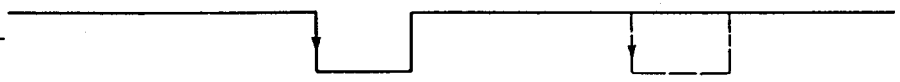
FIG. 10 (b) $\overline{CASO}$
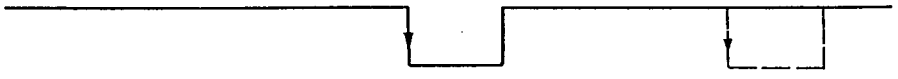
FIG. 10 (c) $\overline{CASI}$
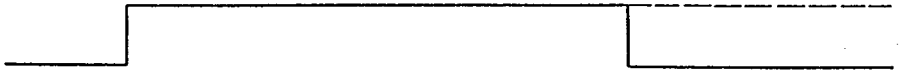
FIG. 10 (d) HSR

VIDEO DISPLAY CONTROLLER

BACKGROUND OF THE INVENTION

1. Field of the Invention

The present invention relates to a video display controller for use in terminal equipment for a computer, a game machine or the like.

2. Prior Art

There have been proposed various kinds of display control systems which comprise a video display processor and display animation and still images on a screen of a CRT (cathode-ray tube) display unit under the control of a CPU (central processing unit). FIG. 1 shows one example of such conventional systems, which example comprises a video display controller (hereinafter referred to as "VDP") 101 and a central processing unit (CPU) 102. The system further comprises a memory 103 which includes a ROM (read only memory) storing a variety of programs to be executed by the CPU 102 and a RAM (random access memory) for storing other necessary data. The CPU 102 outputs data representative of still and animation images to be displayed on a screen of a CRT display unit 104 to the VDP 101 which in turn stores the still and animation data into a video RAM (hereinafter referred to as "VRAM") 105.

Upon receipt of a display command from the CPU 102, the VDP 101 sequentially reads the still and animation data from the VRAM 105 in accordance with scanning synchronization signals of the CRT display unit 104, and supplies the read data to the CRT display unit 104 thereby to display the still and animation images on the screen of the CRT display unit 104.

Such a video display controller, as described above is generally provided with a kind of code converter called a color palette circuit. The color palette circuit converts each of color codes (codes for designating colors of display elements which constitute still and animation images on the screen) read from the VRAM into three color data RD (red), GD (green) and BD (blue) each composed of about two or three bits to thereby form a digital RGB signal. On the other hand, when it is desired to output a composite video signal, the color data RD, GD and BD are multiplied respectively by predetermined coefficients in a matrix circuit, and then the multiplication results are added together. The signal thus obtained is outputted as the composite video signal.

The case where a black and white display is performed in the conventional display controller will now be briefly described. As is well known, to obtain a gray scale or achromatic colors such as white, gray and black, the respective color data RD, GD and BD, which correspond to three primary colors, have to be made equal in value to each other. Therefore, in the case where each of the color data RD, GD and BD consists of two bits, a four-gradation display can be realized by data "00", "01", "10" and "11". And in the case where each color data consists of three bits, an eight-gradation display can be realized by data "000", "001", "010", . . . , "111". However, an image displayed using achromatic colors of about eight gradations is poor in quality (somewhat unnatural) as compared with an image displayed by an ordinary black and white television set. Therefore, to obtain a black and white display image of high quality, the image must be displayed using achromatic colors of at least sixteen gradations.

As described above, the conventional display controller is disadvantageous in that a high-quality image can not be reproduced in the black and white display mode because of the insufficiency of gradation. This disadvantage can be overcome by increasing the number of bits of each primary color data. However, the increase of the number of bits of the color data causes a problem in that the number of component elements of the relevant color palette circuit and matrix circuit also increase.

SUMMARY OF THE INVENTION

It is therefore an object of the present invention to provide a video display controller which can increase the number of gradations of a black and white image without increasing the number of bits of the primary color data.

It is another object of the present invention to provide a video display controller which can cause an image to be displayed in any desired color.

According to one aspect of the present invention, there is provided a video display controller for use with a video display unit, a central processing unit and memory means for storing a plurality of image data, to display on a screen of the video display unit an image composed of a plurality of display elements in accordance with the plurality of image data, the video display controller comprising (a) clock signal generating means for generating a clock signal which is synchronized with display timing of the display elements on the screen; (b) reading means responsive to the clock signal for reading the plurality of image data from the memory means; (c) phase angle generating means for generating a plurality of phase angle signals synchronized with the clock signal; and (d) encoder means for multiplying the read image data by a plurality of first predetermined coefficients provided therein in response to the plurality of phase angle signals, respectively, to output data representative of a chrominance of a color which is designated by the read image data, the encoder means multiplying the read image data by a second predetermined coefficient provided therein to output gradation data proportional in value to the second coefficient when the phase angle signal is not supplied thereto; (e) the output of the encoder means being supplied to the video display unit. The image data may comprises a color code representative of a color of the corresponding display element. In this case, the video display controller may further comprise code converting means for converting the color code into three data representative respectively of three primary colors of the color and data combining means, the encoder means comprising first to third encoders for being supplied with the three data, respectively, each of the first to third encoders being provided with a plurality of first predetermined coefficients and multiplying a corresponding one of the three data by the plurality of first predetermined coefficients in response to the plurality of phase clock signals, respectively, to output data representative of a chrominance of a corresponding one of the three primary colors, the data combining means combining the data outputted from the first to third encoders together to form a digital color video signal. The image data may also comprise data representative of an amplitude of a video signal corresponding to the image. In this case, the code converter means converts the amplitude data into data representative of gradation of image of the corresponding display element, the number of bits of the gradation data being less than the total number of bits of the three primary color data, the gradation data being supplied to the first to third encoders in parallel in unit of bits equal in number to those of the each primary color data from the MSB thereof, each of the first to third encoders being provided with a second coefficient and multiplying a specific portion of the unit of bits by the second coefficient when the plurality of phase angle signals are not supplied thereto, each of the second coefficients is of such a value that the gradation data appears at the output of the combining means.

The video display controller may further comprise color burst generating means for generating a color burst in synchronization with the plurality of phase angle signals, and addition means for adding the generated color burst to the output of the encoder means. In this case, the color burst generating means may further comprise control means for selectively stopping the generation of the color burst, and may also comprise phase control means for controlling, the phase of the color burst with respect to those of the plurality of phase angle signals.

BRIEF DESCRIPTION OF THE DRAWINGS

FIGS. 9(*a*) and 9(*b*) are timing charts of signals $\overline{RAS}$ and $\overline{CAS0}$ in the G IV and G V modes;

FIGS. 10(*a*)–10(*d*) are timing charts of the signals $\overline{RAS}$ and $\overline{CAS0}$, signal $\overline{CAS1}$ and signal HSR in the G VI mode;

DESCRIPTION OF THE PREFERRED EMBODIMENT OF THE INVENTION

Figure 2:
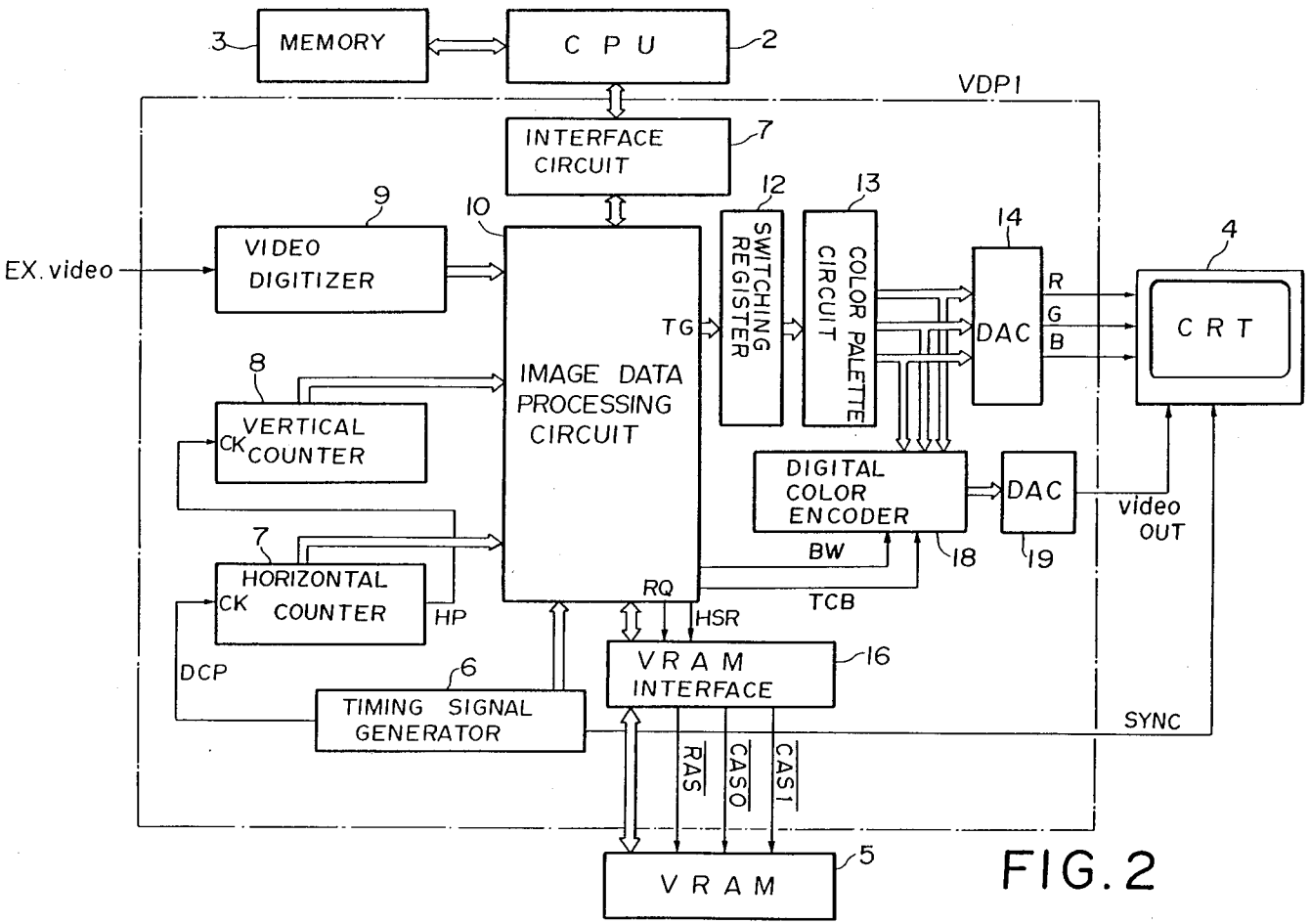
FIG. 2 is a block diagram of a video display control system comprising a video display controller 1 provided in accordance with the present invention.

Shown in FIG. 2 is a video display control system which includes a video display controller 1 (hereinafter referred to as "VDP") provided in accordance with the present invention. The VDP 1 causes animation and a still images to be displayed on a screen of a CRT display unit 4 in accordance with image data stored in a VRAM (video RAM) 5. Also, the VDP 1 allows the contents of the VRAM 5 to be changed and causes a part of the contents of the VRAM 5 to be transferred to the outside in accordance with various kinds of commands or image data supplied from a CPU (central processing unit) 2. A memory 3 stores programs to be executed by the CPU 2 and various kinds of image data.

The VDP 1 will now be more fully described.

A timing signal generator 6 generates reference clock pulses by means of a X'tal oscillator provided therein, and also generates, in accordance with the reference clock pulse, a dot clock pulse DCP and a synchronization signal SYNC. The dot clock pulse DCP is outputted to a clock terminal CK of a horizontal counter 7, while the synchronization signal SYNC is outputted to the CRT display unit 4. The dot clock pulse DCP corresponds to each display element on the CRT display screen, in other words, the dot clock pulse DCP is synchronized with a display timing of each of the display elements which are sequentially displayed on the screen in accordance with the horizontal scanning of the screen. The timing signal generator 6 also generates various kinds of timing signals necessary for processing the image data and outputs them to an image data processing circuit 10.

The horizontal counter 7 is reset when each horizontal scanning of the screen is started, and each time a predetermined number of dot clock pulses DCP are counted, the horizontal counter 7 outputs a signal HP to a clock terminal CK of a vertical counter 8. An output of the horizontal counter 7 represents the sequential number of the display elements on a horizontal scanning line which is currently scanned, the display elements being counted from the leftmost element on the horizontal scanning line. For example, when the output of the horizontal counter 7 is "0" an electron beam of the CRT display unit 4 is directed to the leftmost display element on a horizontal scanning line, and when the output of the horizontal counter 7 is "100" the electron beam is directed to the 101st display element on a horizontal scanning line.

The vertical counter 8 is reset each time the vertical scanning of the screen is started, so that the contents of the vertical counter 8 represent the sequential number of the horizontal scanning line which is currently scanned by an electron beam. In this embodiment, the horizontal scanning lines are counted from the uppermost line on the screen, and the number of the horizontal scanning lines on the display screen is set to "192".

The VDP 1 also comprises a video digitizer 9 which samples an analog video signal, supplied from an external video device, at a predetermined rate, and converts signal levels or amplitudes of the sampled signals into digital data each composed of two or four bits. The amplitude data thus outputted from the video digitizer 9 represent a still image and are supplied to the image data processing circuit 10.

The image data processing circuit 10 selectively stores into the VRAM 5 the amplitude data supplied from the video digitizer 9 and color codes supplied from the CPU 2 through the interface circuit 17. Each of the color codes supplied from the CPU 2 represents a color of a respective one of the display elements constituting a still image on the screen and is composed of two or four bits. In this case, which of (a) the color codes and (b) the amplitude data should be written into the VRAM 5 is determined by the CPU 2, and the selected data (the color codes or the amplitude data) are written into the same storage area of the VRAM 5. The sampling rate of the video digitizer 9 is set to either 5 MHz or 10 MHz (actually, 10.74 MHz which is three times as high as the color subcarrier frequency of 3.58 MHz in the NTSC system). In the following description, both of the color code and the amplitude data are collectively referred to as "dot data".

Figure 3:
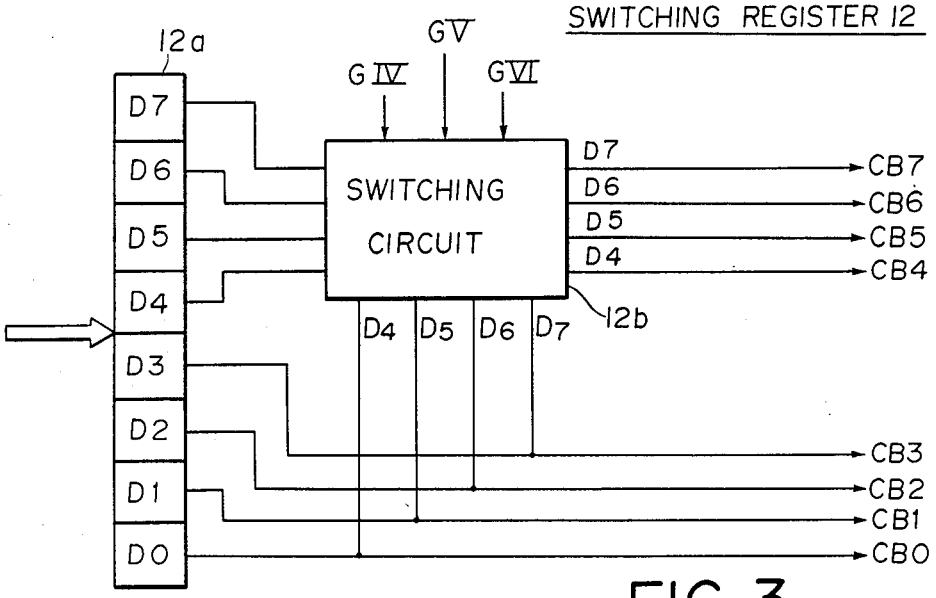
FIG. 3 is a circuit diagram of a switching register 12 of the video display controller 1 shown in FIG. 2.
Figure 4:
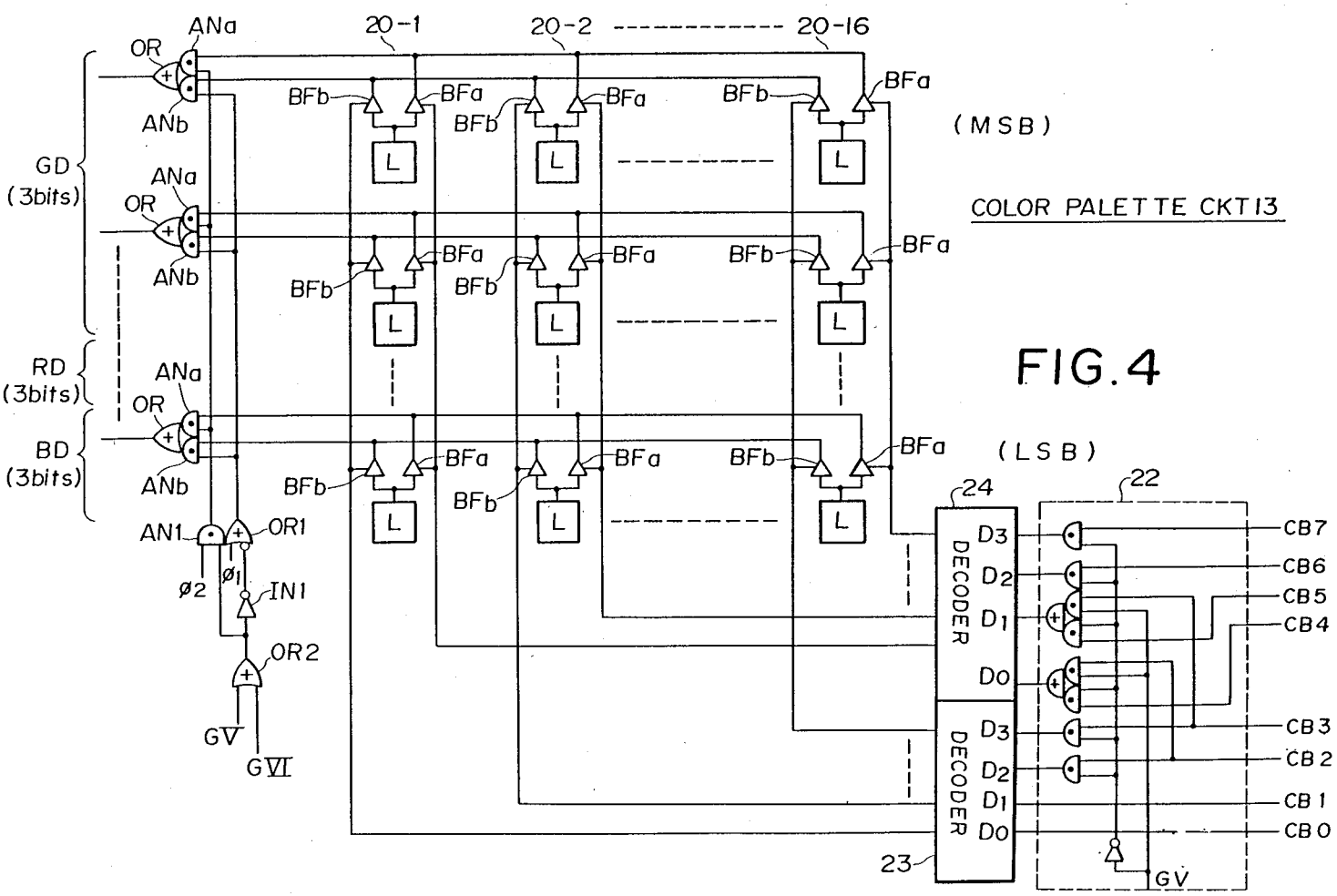
FIG. 4 is a circuit diagram of a color palette circuit 13 of the video display controller 1 shown in FIG. 2.

When a display command is supplied from the CPU 2, the image data processing circuit 10 sequentially reads from the VRAM 5 the dot data in synchronization with the scanning position of the electron beam indicated by the contents of the horizontal and vertical counters 7 and 8, and outputs the read dot data from its output terminal TG to a color palette circuit 13 through a switching register 12. At the same time, the image data processing circuit 10 calculates and reads data necessary for displaying the animation image from the VRAM 5, and then supplies color codes obtained as the result of the above operation to the color palette circuit 13. In the case where the animation image and the still image are located at the same display position on the screen, the animation image is preferentially displayed. The switching register 12 comprises, as shown in FIG. 3, an eight-bit register 12*a* for storing each dot data read from the VRAM 5, and a switching circuit 12*b* which outputs the upper four-bit data (D4 to D7) contained in the register 12*a* selectively onto the upper four bit-lines CB4 to CB7 and the lower four bit-lines CB0 to CB3 of a color bus. The lower four-bit data contained in the register 12*a* is always outputted onto the lower four bit-lines CB0 to CB3 of the color bus, and the bit-lines CB0 to CB7 are connected to input terminals of the color palette circuit 13 (FIG. 4). The operation of the switching circuit 12*b* will be more fully described later.

The color palette circuit 13 is a kind of code converter and converts each color code fed from the switching register 12 into three color data RD (red), GD (green) and BD (blue) each composed of three bits. These color data RD, GD and BD are supplied to a digital-to-analog converter (DAC) 14. When the data fed from the switching register 12 is the amplitude data, the color palette circuit 13 outputs gradation data (five bits in this embodiment) which corresponds to the fed amplitude data. The DAC 14 converts the color data RD, GD and BD into analog color signals R, G and B, respectively, and then outputs these color signals R, G and B to the CRT display unit 4.

Figure 5:
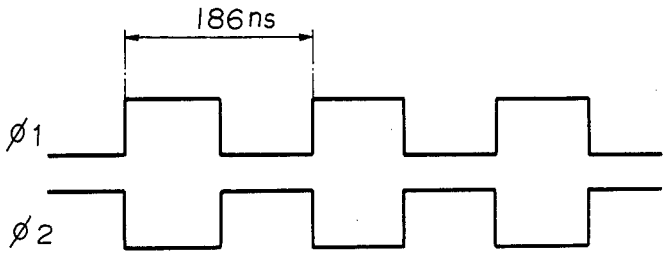
FIG. 5 is a timing chart of pulse signals $\phi$1 and $\phi$2 appearing in the color palette circuit 13 of FIG. 4.

FIG. 4 shows the construction of the color palette circuit 13. Shown at L, L, . . . in FIG. 4 are one-bit registers, into each of which bit data of "1" or "0" is stored in advance. Nine of these registers L, L, . . . each accompanying a pair of tri-state buffer amplifiers BFa and BFb constitute one of sixteen color-data output sections 20-1 to 20-16. In the case where an image is displayed based on the amplitude data, the sixteen color-data output sections 20-1 to 20-16 previously store sixteen color data each composed of three primary color data, and in the case where an image is displayed based on the amplitude data, the color-data output sections 20-1 to 20-16 previously store sixteen gradation data each composed of, for example, five bits. Each pair of the tri-state buffer amplifiers BFa and BFb is connected to the corresponding register L so as to enable and disable the output of the content of the register L. In the case where the color data are stored in the registers L, the nine registers L constituting each of the color-data output sections 20-1 to 20-16 are grouped on a three-register unit basis from the LSB thereof into three portions which output the blue color data BD, red color data RD and green color data GD, respectively. More specifically, the first to third bits of each color-data output section output the blue color data BD, the fourth to sixth bits output the red color data RD, and the seventh to ninth bits output the green color data GD. And in the case where the gradation data of five bits are stored in the color-data output sections 20-1 to 20-16, each gradation data is outputted from the fifth to ninth bits of the corresponding color-data output section. Nine AND gates ANa and nine AND gates ANb are respectively provided in correspondence to each bit portion of the respective color-data output sections 20-1 to 20-16. Output terminals of the buffer amplifiers BFa corresponding to the same bit portion of the respective color-data output sections 20-1 to 20-16 are connected to one input terminal of the corresponding AND gate ANa. In a similar manner, output terminals of the buffer amplifiers BFb corresponding to the same bit portion of the respective color-data output sections 20-1 to 20-16 are connected to one input terminal of the corresponding AND gate ANb. The other input terminals of the AND gates ANa are connected to an output terminal of an AND gate AN1. And the other input terminals of the AND gates ANb are connected to an output terminal of an OR gate OR1. One input terminal of the OR gate OR1 is connected to an output terminal of an inverter IN1 whose input terminal is supplied with an output signal of an OR gate OR2. The output signal of this OR gate OR2 is also supplied to one input terminal of the AND gate AN1. Input terminals of the OR gate OR2 are supplied with mode signals GV and GVI which are rendered "1" in G V and G VI display modes, respectively, as will be described later. Clock pulse signals $\phi 1$ and $\phi 2$ are supplied to the other input terminals of the AND gate AN1 and OR gate OR1, respectively. As shown in FIG. 5, the pulse signals $\phi 1$ and $\phi 2$ are 180° out of phase from each other and each pulse signal has a period of 186 nsec. This period of 186 nsec corresponds to a time period required to display one display element when 256 dots are to be displayed on one horizontal scanning line.

A bit shift circuit 22 in FIG. 4 operates only in the G V mode and supplies the data on the bit lines CB2 and CB3 of the color bus to input terminals D0 and D1 of a binary-to-decimal decoder 24 and at the same time prevents the data on the bit lines CB2, CB3, CB6 and CB7 of the color bus from being supplied to input terminals D2 and D3 of a binary-to-decimal decoder 23 and of the decoder 24. When the bit shift circuit 22 is in the nonoperative state, the data on the bit lines CB0 to CB3 are supplied to the input terminals D0 to D3 of the decoder 23, and the data on the bit lines CB4 to CB7 are supplied to the input terminals D0 to D3 of the decoder 24. Each of the decoders 23 and 24 outputs a selection signal to select one of the color-data output sections 20-1 to 20-16 in accordance with the data supplied to the input terminals D0 to D3 thereof. In this case, the selection signals outputted from the decoder 23 are supplied to the buffer amplifiers BFb as enable signals, while the selection signals outputted from the decoder 24 are supplied to the buffer amplifiers BFa as enable signals. Therefore, output signals of the registers L of the color-data output section selected by the decoder 23 are supplied to one of the input terminals of the AND gates ANb. On the other hand, the contents of the registers L of the color-data output section selected by the decoder 24 are supplied to one of the input terminals of the AND gates ANa.

Referring again to FIG. 2, shown at 16 is a VRAM interface for controlling transfer of data between the image data processing circuit 10 and the VRAM 5. The VRAM interface 16 outputs at proper timings a row address strobe signal $\overline{RAS}$ and column address strobe signals CAS0 and CAS1 to the VRAM 5 in response to a VRAM access request signal RQ and a high speed read signal HR which are supplied from the image data processing circuit 10. After outputting the signal $\overline{RAS}$, the VRAM interface 16 outputs only the signal CAS0 when the access request signal RQ is supplied but when the signal HSR is not supplied. On the other hand, when the signal HSR is supplied together with the signal RQ, the VRAM interface 16 sequentially outputs the signals CAS0 and CAS1 after outputting the signal $\overline{RAS}$.

The mode of this system to display a still image will now be described.

There are a plurality of still image display modes in this system, which are broadly classified into a pattern display mode (in which selected patterns each composed of, for example, 8×8 or 8×6 display elements or dots are displayed), and a dot-map mode (in which colors of the display elements constituting the entire display screen are designated individually). This dot-map mode further includes three kinds of display modes, namely, G IV, G V and G VI modes.

Each of these display modes will now be described.

(1) G IV mode

Figure 6:
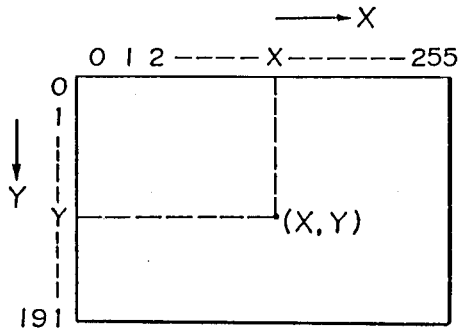
FIGS. 6(*a*) and 6(*b*) are illustrations showing the relation between display elements on the screen and color codes thereof stored in a VRAM 5 in G IV mode.
Figure 6:
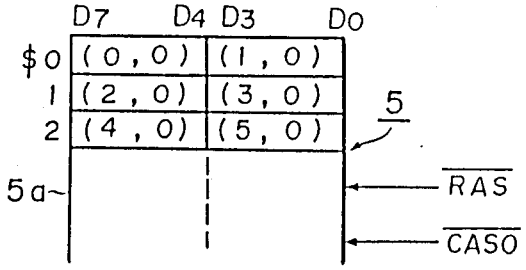

In this G IV mode, the screen is constituted by 256×192 display elements as shown in FIG. 6(*a*) and color codes (or amplitude data) corresponding respectively to those display elements are stored in a still data image area 5*a* of the VRAM 5 in the order shown in FIG. 6(*b*). In this case, each color code (or amplitude data) is composed of four bits so that each address of the still image data area 5*a* stores two color codes. And as each color code is composed of four bits, one of sixteen colors can be designated with respect to each display element in this display mode.

(2) G V mode

Figure 7:
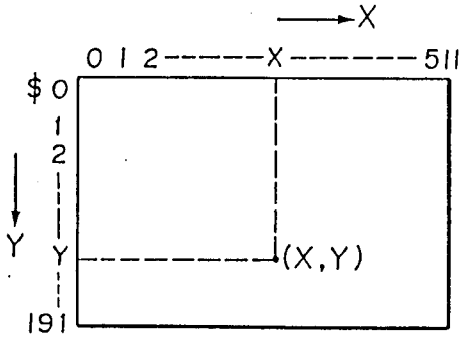
FIGS. 7(*a*), 7(*b*), 8(*a*), and 8(*b*) are illustrations similar to FIG. 6 but showing such relations in G V and G VI modes, respectively.
Figure 7:
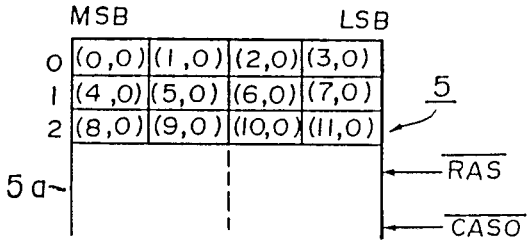

In this G V mode, as shown in FIG. 7(*a*), the screen is constituted by 512×192 display elements and the color codes (or amplitude data) of all the display elements are stored in the still image data area 5*a* in the order shown in FIG. 7(*b*). Each color code (or amplitude data) in this mode consists of two bits and four color codes (or amplitude data) are stored in each address of the still image data area 5*a*. In the G V mode, the number of bits of one color code is two, so that up to four colors can be designated per one display element. The VRAM 5 in this G V mode and in the foregoing G IV mode is constituted by dynamic RAMs having addresses each composed of eight bits. The VRAM 5 latches a row address when the signal $\overline{RAS}$ is supplied and latches a column address when the signal $\overline{CAS0}$ is supplied. An address to be accessed is thus specified when both of the signals $\overline{RAS}$ and $\overline{CAS0}$ are supplied.

(3) G VI mode

Figure 8:
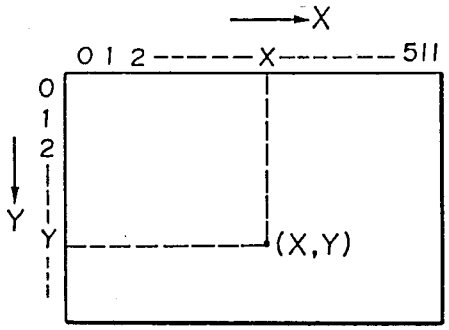
Figure 8:
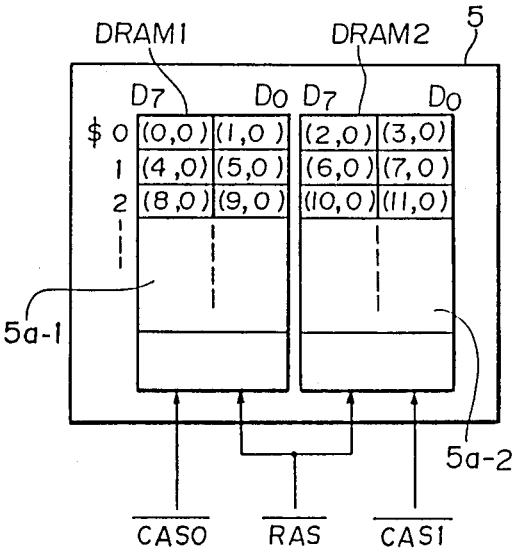

In this mode, as shown in FIG. 8(*a*), the screen is constituted by 512×192 display elements and each color code (or amplitude data) is composed of four bits similarly to the G IV mode. In this G VI mode, storage area of the VRAM 5 is formed by two dynamic RAMs DRAM1 and DRAM2 as shown in FIG. 8(*b*). Color codes (or amplitude data) corresponding to all display elements on the display screen are stored in still image data areas 5*a*-1 and 5*a*-2, provided respectively in the DRAM1 and DRAM2, in the order shown in FIG. 8(*b*). In this case, the DRAM1 and DRAM2 are arranged so as to have the same addresses. The DRAM1 and DRAM2 latch a row address when the signal $\overline{RAS}$ is supplied, and latch column addresses when the signal $\overline{CAS0}$ and $\overline{CAS1}$ are supplied, respectively.

Figure 11:
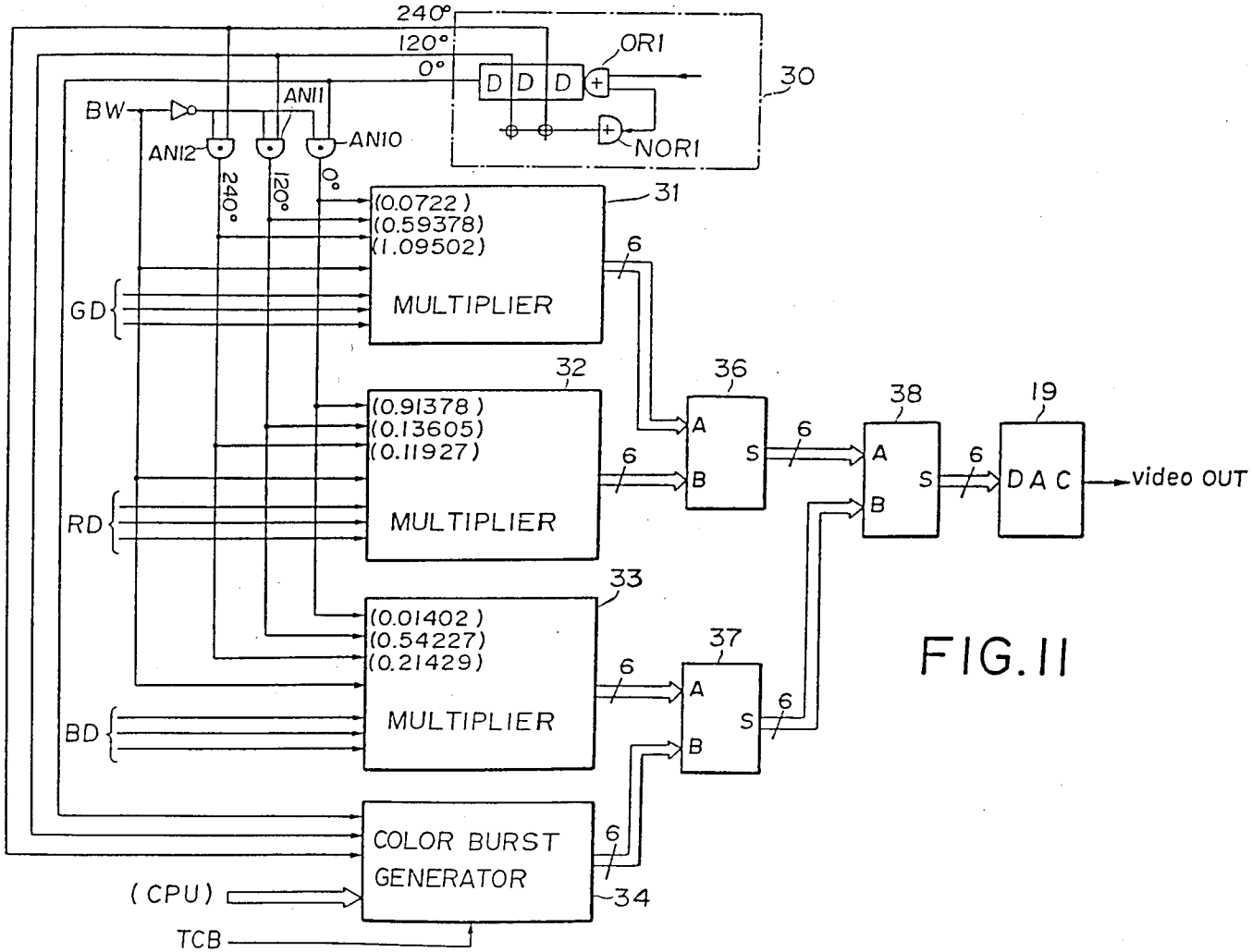
FIG. 11 is a block diagram of a digital color encoder 18 of the video display controller 1 shown in FIG. 2.
Figure 12:
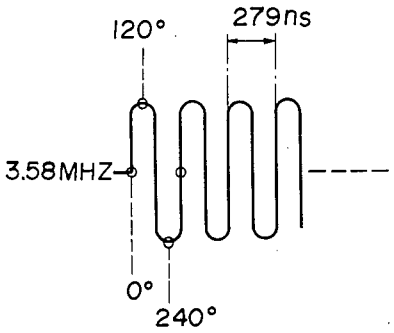
FIG. 12 is a timing chart of a color burst signal produced in accordance with an output of a color burst generator shown in FIG. 11.

A digital color encoder 18 produces a digital composite video signal on the basis of the five-bit gradation data or color data RD, GD and BD which are supplied from the color palette circuit 13, and outputs this video signal through a DAC to the CRT display unit 4. FIG. 11 shows an arrangement of the digital color encoder 18. A burst timing generating section 30 sequentially and repeatedly outputs a 0°-signal, 120°-signal and 240°-signal at an interval of 93 nsec when a start signal is supplied. In this case, the burst timing generating section 30 comprises three delay circuits D which are triggered by a clock signal of 93 nsec, a NOR gate NOR1 and an OR gate OR1. The 0°-signal, 120°-signal and 240°-signal are outputted at timings corresponding respectively to phases 0°, 120° and 240° of the color burst signal, as shown in FIG. 12. These signals are successively outputted even when the color burst signal is not required. The 0°-signal, 120°-signal and 240°-signal are supplied to multipliers 31 to 33 through AND gates AN10, AN11 and AN12, respectively, and are also supplied to a color burst generator 34. In the case where a signal BW ("1" signal) is not supplied, the multipliers 31, 32 and 33 multiply the color data GD, RD and BD respectively by coefficients, which are previously provided therein and are selected by the 0°-, 120°- and 240°-signals, and then output the results (each six bits) of these multiplications.

The coefficients which are selectively used by the multipliers 31 to 33 will now be briefly described.

As is well known, the composite video signal of the NTSC system is expressed by the following equation:

$$E(t) = Y + 0.493(B - Y)\sin wt + 0.877(R - Y)\cos wt \quad (1)$$

where Y is a luminance signal, (B−Y) is a color-difference signal of blue, (R−Y) is a color-difference signal of red, and "w" is $2\pi f$ (f=3.58 MHz which is the frequency of the color subcarrier and is actually 3.579545 MHz). The luminance signal Y is expressed using the chrominance signals R, G and B as:

$$Y=0.2999R+0.587G+0.114B \quad (2)$$

The color-difference signals of blue and red are expressed respectively by:

$$(B-Y)=-0.299R-0.587G+0.886B \quad (3)$$

$$(R=Y)=0.701R-0.587G-0.114B \quad (4)$$

Figure 13:
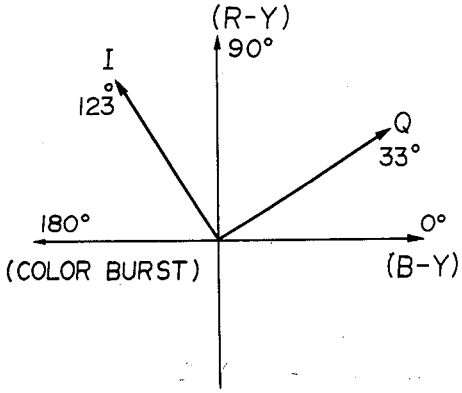
FIG. 13 is an illustration showing demodulation axes provided in a CRT display unit 4 shown in FIG. 2.

FIG. 13 shows phases of the color-difference signals (B−Y) and (R−Y) in the case where the phase of the color burst signal is set to 180°. As shown in FIG. 13, the phases of the color-difference signals (B−Y) and (R−Y) are 0° and 90°, respectively. In an ordinary television receiver, the demodulation is performed using the (B−Y) and (R−Y) axes as demodulation axes. However, there are some TV receivers in which a Q axis (which is advanced by 33° from the (B−Y) axis) and an I axis (which is further advanced by 90° from the Q axis) are used as the demodulation axes. Thus, proper demodulation axes (or modulation axes) can be selected, and the equation relating to each selected axis can be obtained by summing the results of multiplications of chrominance signals R, G and B by the coefficients which are determined in accordance with the selected axis.

In this embodiment, the composite video signal represented by the foregoing equation (1) is synthesized using the following equations which are derived when the sampling is performed at a frequency which is three times as high as that of the color subcarrier.

$$E(0\pi/3w)=0.91378R+0.07220G+0.01402B \quad (5)$$

$$E(2\pi/3w)=-0.13605R+0.59378G+0.54227B \quad (6)$$

$$E(4\pi/3w)=-0.11927R+1.09502G+0.21429B \quad (7)$$

More specifically, the coefficients of the respective chrominance signals R, G and B represented by the equations (5) to (7) are previously provided in the multipliers 31 to 33, and those coefficients are selectively used in accordance with the 0°-signal ($0\pi/3w$), 120°-signal ($2\pi/3w$) and 240°-signal ($4\pi/3w$) as multipliers to the color data GD, RD and BD, respectively.

Figure 14:
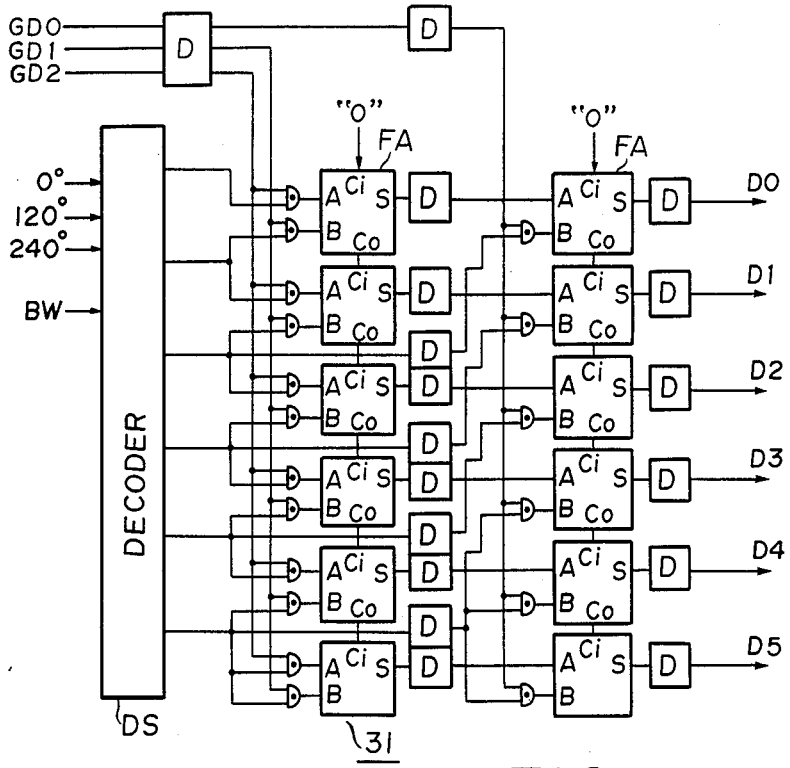
FIG. 14 is a circuit diagram of a multiplier 31 of the digital color encoder 18 of the video display controller 1 shown in FIG. 2.
Figure 1:
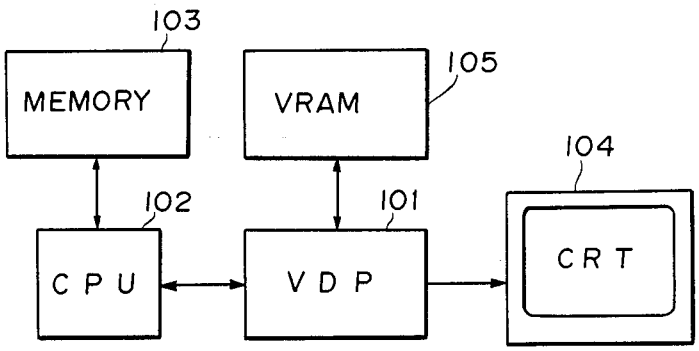
FIG. 1 (PRIOR ART)
FIG. 1 is a block diagram of a video display control system comprising a conventional video display controller.

FIG. 14 shows, by way of example, circuitry of the multiplier 31, the other multipliers 32 and 33 being similar in construction to the multiplier 31. As shown in FIG. 14, the multiplier 31 comprises twelve full adders FA, eighteen delay circuits D and a decoder DS. When each of the 0°-, 120°- and 240°-signals is supplied, the decoder DS outputs six-bit coefficient data which represents a corresponding one of the coefficients of "G" in the equations (5) to (7) so that the multiplication result of the green color data GD by the coefficient is outputted from this multiplier 31. When none of the 0°-, 120°- and 240°-signals and the BW signal is supplied, the decoder DS outputs "0" signals from all output terminals thereof. When all outputs of the decoder DS become "0", the multiplier 31 outputs "0" signals from all output terminals thereof irrespective of the data which is supplied thereto. Six-bit output data of the multipliers 31 to 33 are added together by adders 36 to 38 (FIG. 11), and therefore, output data of the adder 38 during the time when the signal BW is not outputted become the digital video signal and this digital video signal is converted into an ordinary analog video signal by means of the DAC 19. In this case, the color data are sequentially outputted from the color palette circuit 13 at a speed of 10.74 MHz in synchronism with the foregoing phase-angle signals (the detail will be described later).

On the other hand, when the signal BW is supplied, the decoder DS (FIG. 14) outputs data representative of a predetermined coefficient, which is suitable for the black and white display. More specifically, the decoder DS outputs such coefficient data that cause the portion (three bits) of the gradation data, which is supplied to this multiplier 31, to be outputted from the third to fifth output terminals D2 to D4 of the multiplier 31. Also, a decoder DS of the multiplier 32 (not shown) outputs such coefficient data that cause the portion (two bits) of the gradation data, which is supplied to this multiplier 32, to be outputted from the first and second output terminals D0 and D1 of the multiplier 32, while a decoder DS of the multiplier 33 (not shown) outputs such coefficient data that cause data of "0" to be outputted from the multiplier 33.

The color burst generator 34 (FIG. 11) outputs the color burst signal data (six bits) at a predetermined timing, i.e., at a timing corresponding to a back porch of the horizontal synchronization signal.

Figure 15:
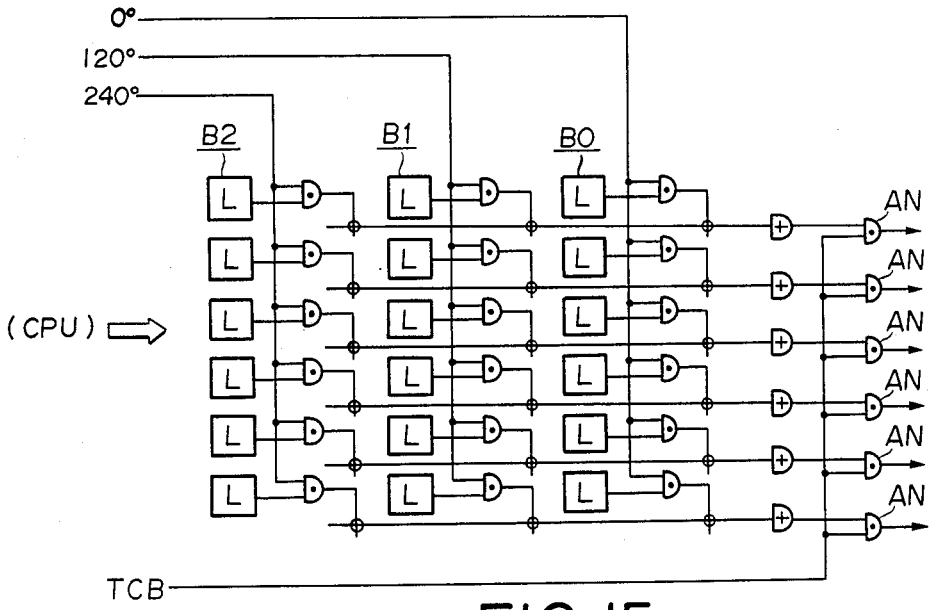
FIG. 15 is a circuit diagram of the color burst generator 34 of the digital color encoder 18 of FIG. 11.

The color burst generator 34 will now be more fully described with reference to FIG. 15.

The color burst generator 34 comprises eighteen one-bit registers L whose content ("1" or "0") can be changed by the CPU 2. Every six registers L constitute one group, and these groups constitute memory blocks B0, B1 and B2. In this case, the memory blocks B0, B1 and B2 store the respective amplitude values (six bits) of the color burst signal at 0°, 120° and 240° (refer to FIG. 12), five bits among the six bits representing the amplitude, and the remaining one bit representing the sign. The data in the memory blocks B0 to B2 are outputted through the AND gates, provided respectively at their output terminals, when the 0°-, 120°- and 240°-signals are supplied, respectively. The data thus outputted from the memory blocks B0 to B2 are supplied to the adder 37 (FIG. 11) only when the AND gates AN, AN, . . . are opened. The AND gates AN are opened by a signal TCB which the image data processing circuit 10 generates at the timing when the color burst signal data is to be outputted. The color burst signal data which is outputted at the above-mentioned timing is added to the foregoing digital video signal data by the adders 37 and 38. The color burst generator 34 is thus constructed so as to output a color burst based on the standard NTSC system, however, by changing the data stored in the memory blocks B0 to B2, the phase of the color burst signal can be changed so that colors of the image displayed on the screen are varied.

The case where the signal BW is outputted will now be described. When the signal BW is outputted, this signal BW is supplied to the multipliers 31 to 33, and at this time the AND gates AN10 to AN12 (FIG. 11) are closed so that the 0°-, 120°- and 240°-signals are not supplied to the multipliers 31 to 33. Also, the gradation data or primary color data, each composed of three-bit groups and outputted from the color palette circuit 13, are supplied to the multipliers 31 to 33, respectively. The preselected portions of the foregoing data thus inputted to the multipliers 31 to 33 are then multiplied by the coefficients necessary for the gradation display, and the remaining portions of the inputted data are multiplied by "0". Then, these multiplication results are added together by the adders 36 to 38 to thereby form the gradation signal data. When it is desired to display an image with thirty-two gradations, five-bit information is needed as the portions of the data which are subjected to the multiplications by the coefficients. Therefore, the three-bit data which is inputted to the multiplier 31 (one of the portions of the data) and the two-bit data which is inputted to the multiplier 32 (the other of the portions of the data) are selected and are multiplied by the respective coefficients, while the non-selected portions of the data are multiplied by "0", whereby a video signal data capable of representing thirty two gradations is obtained. To increase the number of gradations, the number of bits of those portions of the data which are subjected to multiplications by proper coefficients should be increased.

The operation of this system will now be described.

In the operation of this system, there is a case where the display of a still image is performed in accordance with the color codes stored in the VRAM 5. There is also another case where the display of a still image is performed in accordance with the amplitude data stored in the VRAM 5. And therefore, by way of example, the former case in the G V mode is first described and thereafter the latter case in the G VI mode will be described.

(a) Display of image based on color codes in the G V mode

In this mode, the number of bits of still image data which are read from the VRAM 5 during a period of one horizontal scanning is 1024 (2 bits×512=1024 bits), so that data of 128 bytes must be read from the VRAM 5 during that period. To read out the still image data of about 128 bytes during one horizontal scanning, it is not necessary to provide an extremely high access speed, and therefore, an access in the VRAM 5 to the conventional manner is performed. More specifically, the image data processing circuit 10 calculates each address of the VRAM 5, in which color codes necessary for displaying display elements of the still image are stored, in accordance with the contents of the horizontal and vertical counters 7 and 8. Then, the image data processing circuit 10 sequentially outputs to the VRAM 5 the row address and column address corresponding to the calculated address. At the same time, the VRAM interface 16 sequentially outputs the row address strobe signal $\overline{RAS}$ and column address strobe signal $\overline{CAS0}$ to the VRAM 5. As a result, an access to the address of the VRAM 5 is established, so that the color codes are read from the accessed address and supplied through the VRAM interface 16 to the image data processing circuit 10.

FIGS. 9(*a*) and 9(*b*) show the signals $\overline{RAS}$ and $\overline{CAS0}$ which are outputted from the VRAM interface 16 in the foregoing case. As shown in FIGS. 9(*a*) and 9(*b*), when the access request signal RQ is outputted from the image data processing circuit 10, the VRAM interface 16 first outputs the signal $\overline{RAS}$ and then outputs the signal $\overline{CAS0}$ after a predetermined time. The VRAM 5 latches the row address at the leading edge of the signal $\overline{RAS}$ and latches the column address at the leading edge of the signal $\overline{CAS0}$. After a lapse of a predetermined time from the leading edge of the signal $\overline{CAS0}$, the VRAM 5 outputs the color code data, which includes four color codes, from the accessed address. Then, the VRAM interface 16 stops the output of the signals $\overline{CAS0}$ and $\overline{RAS}$. And thereafter, each time the image data processing circuit 10 outputs new address data, the VRAM interface 16 performs an operation similar to the above operation. In this case, if the row address of each of the addresses to be accessed does not change, the output of the signal $\overline{RAS}$ is held unchanged, as indicated by a broken line in FIG. 9(*a*), and the signal $\overline{CAS0}$ is outputted each time a new address is outputted from the image data processing circuit 10.

The data of one byte read from the accessed address of the VRAM 5 is once stored in the register 12*a* of the switching register 12 and the switching circuit 12*b* outputs in sequence the upper four bits and the lower four bits of the stored data onto the bit-lines CB0 to CB3 of the color bus.

Next, the operation of the color palette circuit 13 will be described. As described above, each data which is sequentially outputted onto the bit-lines CB0 to CB3 of the color bus includes two color codes. The bit shift circuit 22 supplies one of the two color codes on the bit-lines CB0 to CB1 to the input terminals D0 and D1 of the decoder 23 and supplies the other one of the two color codes on the bit lines CB2 and CB3 to the input terminals D0 and D1 of the decoder 24. Each of the decoders 23 and 24 then outputs the corresponding selecting signal so that one of the color-data output sections 20-1 to 20-16 is selected in accordance with the color code supplied thereto. The color data in the register L of the color-data output section thus selected by the decoder 23 are supplied to one of the input terminals of the AND gates ANb through the selected buffer amplifiers BFb. In a similar manner, the color data in the register L of the color-data output section thus selected by the decoder 24 are supplied to one of the input terminals of the AND gates ANa through the selected buffer amplifiers BFa. Incidentally, in this G V mode, the output signal of the OR gate OR2 is "1", so that the pulse signals $\phi$1 and $\phi$2 are supplied to the other input terminals of the AND gates ANb and the other input terminals of the AND gates ANa through the OR gate OR1 and the AND gate AN1, respectively. Consequently, the AND gates ANa and AND gates ANb alternately open, so that the color data in the color-data output section selected by the decoder 23 and the color data in the color-data output section selected by the decoder 24 are alternately outputted through the OR gates OR. Thus, the interval of the output of each color data through the OR gates OR becomes half of that of the pulse signal $\phi$1 ($\phi$2), i.e., 92 nsec, so that 512 display elements can be displayed on one horizontal scanning line in accordance with the color signals R, G and B outputted from the DAC 14. On the other hand, if the color data, which are outputted from the color palette circuit 13 at an interval of 93 nsec, are supplied to the digital color encoder 18, the still image can be displayed on the screen of the CRT display unit 4 in accordance with the digital video signal outputted from the digital color encoder 18. The operation of this system in this particular case will now be described hereunder.

When the color data GD, RD and BD are supplied respectively to the multipliers 31, 32 and 33 at a speed of 10.74 MHz (93 nsec), and when the 0°-signal, the 120°-signal, and the 240°-signal are also supplied respectively to the multipliers 31, 32 and 33 in accordance with the scanning of the screen (in this case, it is assumed that the signal BW is not outputted), arithmetic operations represented by the equations (5) to (7) are carried out every 93 nsec. As a result, the digital video signals represented by the equation (1) are outputted from the adder 38 (FIG. 11). On the other hand, the color burst generator 34 generates data representative of the color burst signal based on the standard NTSC system each time the signal TCB is outputted, i.e., at every backporch of the horizontal synchronization signals. The thus generated color burst signal data are added to the digital video signal by the adders 37 and 38, so that a video signal based on the NTSC system, to which the color burst signal has been added, is outputted from the DAC 19.

(b) Display of the image based on amplitude data in the G VI mode

In this case, amplitude data, each composed of four bits and obtained by sampling the external video signal by the video digitizer 9 at a rate of 10.74 MHz, are stored in the VRAM 5. Also, predetermined sixteen gradation data each composed of five bits are stored respectively in the color-data output sections 20-1 to 20-16, each gradation data being stored in the fifth to ninth registers L of the corresponding color-data output section. In this G VI mode, the number of bits of still image data which are read from the VRAM 5 during one horizontal scanning is 2048 (four bits×512=2048 bits) so that 256 bytes of data must be read from the VRAM 5. To read the still image data of about 256 bytes for displaying display elements on one horizontal scanning line, it is necessary to provide an extremely high-speed access to the VRAM 5. In this embodiment, this high-speed access is realized in a manner described below.

When making an access to the VRAM 5, the image data processing circuit 10 outputs both of the access request signal RQ and the high speed read signal HSR to the VRAM interface 16 and also outputs row address data to the VRAM 5. Subsequently, the VRAM interface 16 outputs the signal $\overline{RAS}$ (FIG. 10(*a*)), and both of the DRAM1 and DRAM2 which constitute the VRAM 5 latch the row address at the leading edge of the signal $\overline{RAS}$. When the image data processing circuit 10 outputs the column address data and when the VRAM interface 16 outputs the signal $\overline{CAS0}$ (FIG. 10(*b*)), access to the address of the DRAM1 is established at the leading edge of this signal $\overline{CAS0}$. As a result, the amplitude data (one byte) in the accessed address is read out and supplied to the image data processing circuit 10 through the VRAM interface 16. Subsequently, the VRAM interface 16 renders the signal $\overline{CAS0}$ high, and immediately after that, it outputs the signal $\overline{CAS1}$. Access to the address of the DRAM2 is established at the leading edge of the signal $\overline{CAS1}$ and the amplitude data (one byte) in the accessed address is read and supplied to the image data processing circuit 10. The address of the DRAM2 accessed at this time is the same as that of the DRAM1 previously accessed, since the column address has not been changed. Then, the VRAM interface 16 renders the signals $\overline{CAS1}$ and $\overline{RAS}$ high. And thereafter, each time the image data processing circuit 10 outputs new address data, the above operation is carried out. In the case where the row address of each of the addresses to be accessed does not change, the output of the signals $\overline{RAS}$ and HSR may be kept active as indicated by brokden lines in FIGS. 10(*a*) and 10(*d*), and each time a new column address is outputted from the image data processing circuit 10, the signals $\overline{CAS0}$ and $\overline{CAS1}$ are outputted at timings indicated by broken lines in FIGS. 10(*b*) and 10(*c*).

The amplitude data thus read from the DRAM1, which includes two amplitude data, is temporarily stored in the register 12*a* of the switching register 12 and is then outputted onto the bit lines CB0 to CB7 of the color bus. And thereafter, the amplitude data read from the DRAM2 is temporarily stored in the register 12*a* and is then outputted onto the bit lines CB0 to CB7. The decoder 23 outputs the selection signal to select, in accordance with the amplitude data on the lower four bit-lines CB0 to CB3 of the color bus, one of the color-data output sections 20-1 to 20-16 which contains the gradation data corresponding to this amplitude data, while the decoder 24 outputs the selection signal to select, in accordance with the amplitude data on the higher four bit-lines CB4 to CB7 of the color bus, one of the color-data output sections 20-1 to 20-16 which contains the gradation data corresponding to this amplitude data. And thereafter, the decoder 23 outputs the selection signal to select one of the color-data output sections 20-1 to 20-16 in accordance with the lower four bits of the amplitude data read from the DRAM2, while the decoder 24 outputs the selection signal to select one of the color-data output sections 20-1 to 20-16 in accordance with the higher four bits of the same amplitude data. The output signals of the OR gates 0R1 and OR2 and AND gate AN1 in this G VI mode are in the same states as those in the foregoing G V mode. Therefore, the gradation data in the color-data output section selected by the decoder 23 and the gradation data in the color-data output section selected by the decoder 24 are alternately outputted through the OR gates OR. As a result, the gradation data are sequentially supplied to the input terminals of the digital color encoder 18 at an interval of 93 nsec. In this case, as each gradation data is composed of five bits, thirty two gradations can be realized. However, the number of the color-data output sections is sixteen, so that desired sixteen gradations (for example, those selected from every two of the thirty two gradations or the sixteen gradations in the bright portion) are previously selected.

Next, the operation of the digital color encoder 18 will be described. In the case where the display of the image should be performed in accordance with the amplitude data the signal BW is outputted so that the AND gates AN10 to AN12 are closed. The signal BW is supplied to the multipliers 31 and 33, whereas the 0°-, 120°- and 240°-signals are prevented from being supplied to the the multipliers 31 to 33. The nine-bit data including the five-bit gradation data is supplied to the multipliers 31 to 33 on a three-bit basis. The multipliers 31 to 33 multiply the predetermined portions of the supplied data respectively by the coefficients, which are necessary for the gradation display, and then output the respective results of these multiplications. As a result, signal data corresponding to the gradation data is outputted from the adder 38, in other words, signal data corresponding to the amplitude data is outputted from the adder 38. Therefore, the output signal of the DAC 19, i.e., the result of digital-to-analog conversion of the output of the adder 38, corresponds to the aforesaid original external video signal. However, the amplitudes of the thus obtained video signal may slightly differ from those of the original video signal in accordance with the way of selection of the gradation data stored in the color palette circuit 13.

When it is desired to display the image in black and white, the color burst generator 34 is rendered inactive so that no color burst signal is generated. This is realized by, for example, previously storing "0" into all of the registers L of the color burst generator 34. In the case where no color burst signal is outputted, the CRT display unit 4 inputs the video signal supplied from the DAC 19 as a mere luminance signal. More specifically, in the case where no color burst signal is added to the video signal, a color killer circuit in the CRT display unit 4 operates so that a color demodulator becomes inactive, and as a result the image is displayed in black and white. The color killer circuit control the operation of the color demodulator in accordance with the presence of the color burst signal and is generally provided in a CRT display unit.

When it is desired to display the image with colors, the color burst generator is rendered active so that the color burst signal is generated. And in the case where amplitude data of the color burst of the standard NTSC system are stored in the memory blocks B0 to B3 of the color burst generator 34, the image is displayed in the same colors as those of the original image whose video signal has been sampled by the video digitizer 9. On the other hand, if the amplitude data stored in the memory blocks B0 to B3 are of a color burst signal whose phase is shifted from that of the standard color burst signal, the demodulation axes in the CRT display unit 4 are deviated so that the image can be displayed in colors different from those of the original image. In this embodiment, the color information is given at three points, i.e., at 0°, 120° and 240°, and thirty two kinds of color information can be given at each point, so that 32768 ($=32^3$) colors can theoretically be used in the display of the image.

As described above, with the construction of this embodiment, the number of gradations of the gray scale can be increased without increasing the number of bits of the primary color data or of the imaga data of each display element. In addition, with the construction of this embodiment, an image based on the reproduced video signal can be displayed in any desired color.

What is claimed is:

1. A video display controller for use with a video display unit, a central processing unit and memory means for storing a plurality of image data, to display on a screen of the video display unit an image composed of a plurality of display elements in accordance with said plurality of image data, said video display controller comprising:

(a) clock signal generating means for generating a clock signal which is synchronized with a display timing of said display elements on said screen;

(b) reading means responsive to said clock signal for reading said plurality of image data from said memory means;

(c) converter means for determining whether each of said read image data represents color data or gradation data, and, responsive to said determining for converting each of said read image data into one of (1 ) color data representative of a color of a corresponding one of said plurality of display elements, or (2) gradation data representative of a gradation of the corresponding one of the plurality of display elements;

(d) phase angle generating means for generating a plurality of phase angle signals synchronized with said clock signal; and (e) encoder means coupled to said phase angle generating means capable of providing (1) a plurality of first predetermined coefficients, and (2) a second predetermined coefficient, and capable of (1) multiplying each of said color data by one of said first predetermined coefficients in response to said plurality of phase angle signals to output data representative of a chrominance of the color represented by said color data, and (2) multiplying said gradation data by said second coefficient to output data proportional in value to said second coefficient when said phase angle signal is not supplied thereto, said output of said encoder means being supplied to said video display unit.

2. A video display controller according to claim 1, wherein each of said color data includes three data representative respectively of three primary colors, said encoder means comprising first to third encoders being supplied respectively with said three primary color data, each of said encoders (1) providing a plurality of first predetermined coefficients and (2) multiplying the supplied primary color data by said first predetermined coefficients in response to said plurality of phase angle signals, respectively, to output data representative of a chrominance of said supplied primary color data, and wherein said video display controller further comprises combining means for combining said data outputted respectively from said first to third encoders together to form a digital color video signal to be supplied to said video display unit.

3. A video display controller according to claim 2, wherein a number of bits of said gradation data is less than a total number of bits of said three primary color data, said gradation data being supplied to said first to third encoders in parallel in a unit of bits equal in number to those of said each primary color data from a most significant bit thereof, each of said first to third encoders further providing said second coefficient and multiplying a specific portion of said supplied gradation data by said second coefficient when said phase angle signals are not supplied thereto, each of said second coefficients provided respectively by said three encoders being of such value that said gradation data appears at an output of said combining means.

4. A video display controller according to claim 3, wherein each of said three primary color data is composed of three bits, said gradation data being composed of five bits.

5. A video display controller according to claim 1 further comprising:

color burst generating means for generating a color burst in synchronization with said plurality of phase angle signals; and addition means for adding said generated color burst to said output of said encoder means.

6. A video display controller according to calim 5, wherein said color burst generating means further comprises control means for selectively stopping the generation of said color burst.

7. A video display controller according to claim 6, wherein said color burst generating means comprises:

a plurality of register means each for receiving and retaining data supplied from the central processing unit; and output control means for outputting said data in said plurality of register means in response to said plurality of phase angle signals, respectively.

8. A video display controller according to claim 5, wherein said color burst generating means further comprises phase control means for controlling phase of said color burst with respect to phases of said plurality of phase angle signals.

9. A video display controller according to claim 8, wherein said color burst generating means comprises:

a plurality of register means each for receiving and retaining data supplied from the central processing unit; and output control means for outputting said data in said plurality of register means in response to said plurality of phase angle signals, respectively;

wherein the central processing unit changes said data in said plurality of register means to control the phase of said color burst.

* * * * *